US009692119B2

(12) United States Patent
Hsieh et al.

(10) Patent No.: US 9,692,119 B2
(45) Date of Patent: Jun. 27, 2017

(54) RADIO-FREQUENCY DEVICE AND WIRELESS COMMUNICATION DEVICE FOR ENHANCING ANTENNA ISOLATION

(71) Applicant: Wistron NeWeb Corporation, Hsinchu (TW)

(72) Inventors: Chia-Hsing Hsieh, Hsinchu (TW); Chung-Hung Chen, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 256 days.

(21) Appl. No.: 14/555,590

(22) Filed: Nov. 27, 2014

(65) Prior Publication Data

US 2015/0180115 A1 Jun. 25, 2015

(30) Foreign Application Priority Data

Dec. 24, 2013 (TW) ..... 102148007 A

(51) Int. Cl.

| | |
|---|---|
| ***H01Q 1/24*** | (2006.01) |
| ***H01Q 1/52*** | (2006.01) |
| ***H01Q 21/28*** | (2006.01) |
| ***H01Q 5/371*** | (2015.01) |

(52) U.S. Cl.

CPC ..... *H01Q 1/523* (2013.01); *H01Q 1/243* (2013.01); *H01Q 5/371* (2015.01); *H01Q 21/28* (2013.01)

(58) Field of Classification Search

CPC ..... H01Q 1/243; H01Q 1/523; H01Q 5/371; H01Q 21/28

USPC ..... 343/702, 841

See application file for complete search history.

(56) References Cited

U.S. PATENT DOCUMENTS 8,937,578 B2 * 1/2015 Montgomery ..... H01Q 1/243 343/702

FOREIGN PATENT DOCUMENTS

| | | |
|---|---|---|
| CN | 102340049 A | 2/2012 |
| CN | 102751573 A | 10/2012 |
| CN | 202513284 U | 10/2012 |
| EP | 2 811 573 A1 | 12/2014 |

* cited by examiner

*Primary Examiner* — Hoang Nguyen

(74) *Attorney, Agent, or Firm* — Winston Hsu

(57) ABSTRACT

A radio-frequency device for a wireless communication device includes an antenna disposition area, a grounding unit, a first antenna and a second antenna. The first antenna includes a feed-in plate; a first radiating element, coupled to the feed-in plate and electrically connected to the grounding unit; and a metal branch, electrically connected to the grounding unit; wherein the grounding unit is shared by the first antenna and the second antenna, the feed-in plate is disposed in-between the metal branch and the first radiating element, and the metal branch is used for guiding a reflected signal generated from the second antenna to the metal branch so as to enhance isolations of the first antenna and the second antenna.

18 Claims, 13 Drawing Sheets

RADIO-FREQUENCY DEVICE AND WIRELESS COMMUNICATION DEVICE FOR ENHANCING ANTENNA ISOLATION

BACKGROUND OF THE INVENTION

1. Field of the Invention

The present invention relates to a radio-frequency device and wireless communication device, and more particularly, to a radio-frequency device and wireless communication device capable of enhancing antenna isolation so as to dispose multiple antennas in a limited space while maintaining preferable antenna efficiency and bandwidth.

2. Description of the Prior Art

Electronic products with wireless communication functionalities, such as laptops, tablet PCs, personal digital assistants (PDAs), mobile phones, wireless base stations, smart meters, and USB dongles, utilize antennas to send and receive wireless signals so as to access wireless networks. In order to let the users access wireless communication networks more conveniently, the antenna bandwidth should be as broad as possible so that more communication protocols can be complied with, while the antenna size should be minimized to meet a demand for smaller and lighter products. In addition, with evolution of wireless communication technologies a wireless communication device may be required to equip more antennas. For example, a modern USB dongle may be equipped with multiple sets of antennas to establish a plurality of antenna channels for spatial diversity and provide multiple antenna patterns, which allows the user to execute different applications using different wireless communication systems (e.g. Bluetooth and Wi-Fi) on the same frequency band at the same time. Furthermore, the spectrum efficiency and the transmission speed may be enhanced with multiple sets of antennas, thereby improving the communication quality. Since multiple sets of antennas are disposed in a communication device, the interference problems have become one of the important design considerations for antenna designs.

In general, multiple sets of antennas are respectively disposed on the diagonal positions or are kept in the farthest distance between one another on the longest edge of a wireless communication device so as to minimize the interference between antennas and achieve better complementary antenna characteristics. However, if the overall size of the wireless communication device or the available space for disposing the antennas is very small, careful considerations must be taken when drawing the layout of the antennas.

In addition, the broadband requirement has become a primary item for antenna designs as the evolution of wireless communication technologies. The common broadband antennas, such as planar inverted-F antennas, can meet the requirement of multi-frequency operation; however, the radiation elements of such antennas are too long to be installed in a miniature wireless communication system. Furthermore, the low frequency band of these kinds of antennas is too narrow (only about 110 MHz) so that they cannot meet the broadband requirement of the wireless communication systems.

Therefore, how to design multiple sets of antennas in a limited space which meets all of the antenna requirements for transmission, bandwidth, efficiency, and isolation is an important topic to be addressed and discussed.

SUMMARY OF THE INVENTION

An objective of the present invention is to provide a radio-frequency device and wireless communication device capable of enhancing antenna isolation so as to dispose multiple sets of antennas in a limited space while maintaining preferable antenna efficiency and bandwidth.

An embodiment of the present invention discloses a radio-frequency device for a wireless communication device. The radio-frequency device includes an antenna disposition area; a grounding unit, for providing ground; a first antenna, disposed in the antenna disposition area for transmitting or receiving a first radio signal; and a second antenna, disposed in the antenna disposition area for transmitting or receiving a second radio signal. The first antenna includes a feed-in plate, having a feed-in part; a first radiating element, coupled to the feed-in plate and electrically connected to the grounding unit for emitting the first radio signal; a first signal feed-in element, electrically connected to the feed-in part for transmitting the first radio signal to the first radiating element via the feed-in plate such that the first radio signal is emitted via the first radiating element; and a metal branch, electrically connected to the grounding unit; wherein the grounding unit between the first antenna and the second antenna is shared by the first antenna and the second antenna, the feed-in plate is disposed in-between the metal branch and the first radiating element, and the metal branch is used for guiding a reflected signal generated from the second antenna to the metal branch so as to enhance isolations of the first antenna and the second antenna.

Another embodiment of the present invention discloses a wireless communication system including a system grounding unit, for providing ground; a radio signal processing unit, for processing a plurality of radio signals; and a radio-frequency device. The radio-frequency device includes an antenna disposition area, wherein the radio signal processing unit is disposed in the antenna disposition area; a grounding unit, electrically connected to the system grounding unit; a first antenna, disposed in the antenna disposition area for transmitting or receiving a first radio signal of the plurality of radio signals; and a second antenna, disposed in the antenna disposition area for transmitting or receiving a second radio signal of the plurality of radio signals. The first antenna includes a feed-in plate, having a feed-in part; a first radiating element, coupled to the feed-in plate and electrically connected to the grounding unit for emitting the first radio signal; a first signal feed-in element, electrically connected to the feed-in part for transmitting the first radio signal to the first radiating element via the feed-in plate such that the first radio signal is emitted via the first radiating element; and a metal branch, electrically connected to the grounding unit; wherein the grounding unit between the first antenna and the second antenna is shared by the first antenna and the second antenna, the feed-in plate is disposed in-between the metal branch and the first radiating element, and the metal branch is used for guiding a reflected signal generated from the second antenna to the metal branch so as to enhance isolations of the first antenna and the second antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
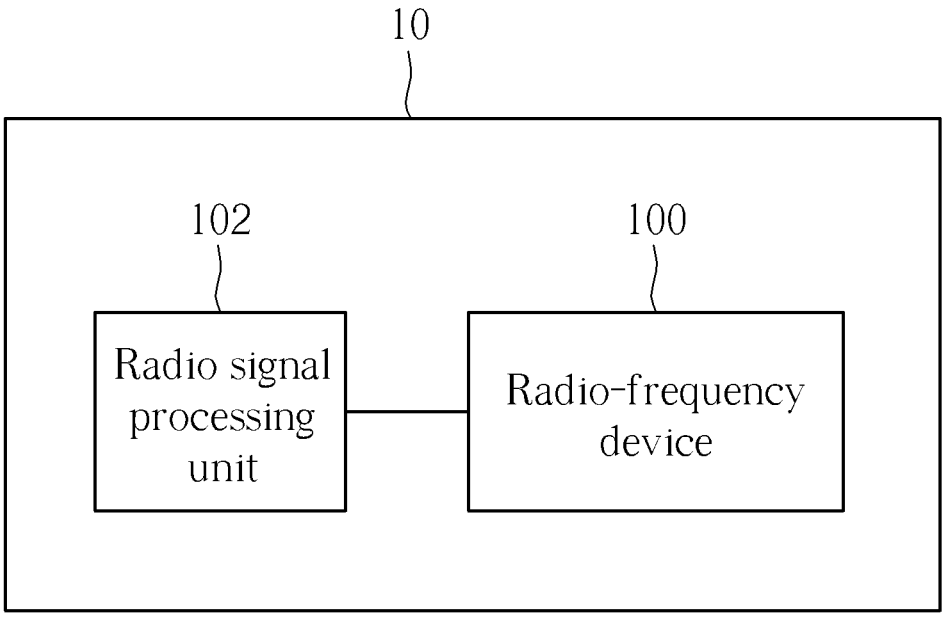
FIG. 1 is a schematic diagram of a wireless communication device according to an embodiment of the present invention.

FIG. 1 is a schematic diagram of a wireless communication device 10 according to an embodiment of the present invention. The wireless communication device 10 may be any electronic product with wireless communication functionalities such as a mobile phone, a computer system, a wireless access point device, a wireless base station, a USB dongle, a laptop, a tablet PC, a personal digital assistant (PDA), and a smart meter. The wireless communication device 10 illustrated in FIG. 1 is briefly composed of a radio-frequency device 100 and a radio signal processing unit 102, but is not limited herein. The radio-frequency device 100 provides a wireless communication functionality of the wireless communication device 10. More specifically, the radio signal processing unit 102 may support an operation of simultaneous transmission or reception of wireless signals in the same frequency band, and the radio-frequency device 100 ensures isolation under this operation. Examples of "simultaneous transmission or reception of wireless signals in the same frequency band" include simultaneously transmitting or receiving wireless signals by a wireless communication system supporting the multiple input multiple output (MIMO) communication protocol, or simultaneously transmitting or receiving wireless signals by different wireless communication systems (e.g., Bluetooth and Wi-Fi) operating in the same frequency band.

Figure 2:
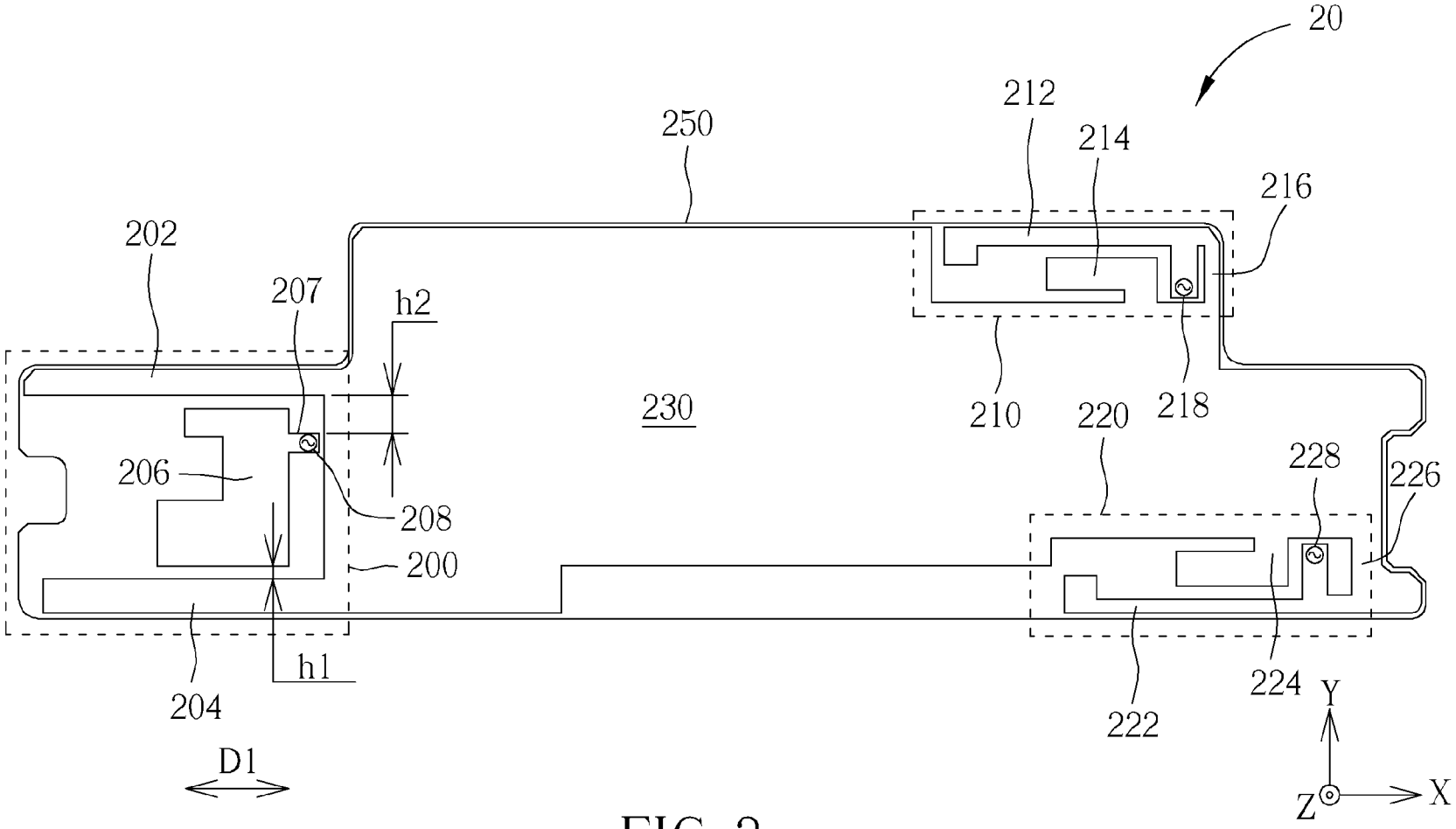
FIG. 2 is a schematic diagram of a radio-frequency device according to an embodiment of the present invention.

FIG. 2 is a schematic diagram of a radio-frequency device 20 according to an embodiment of the present invention. The radio-frequency device 20 may be applied to the radio-frequency device 100 shown in FIG. 1. The radio-frequency device 20 includes a first antenna 200, a second antenna 210, a third antenna 220, a grounding unit 230, and an antenna disposition area 250. The first antenna 200, the second antenna 210, and the third antenna 220 are disposed in the antenna disposition area 250 for simultaneously transmitting or receiving wireless signals of the same frequency band. For example, the first antenna 200 may be used for transmitting or receiving signals of a Bluetooth communication system, and the second antenna 210 and the third antenna 220 may be used for transmitting or receiving signals of a Wi-Fi communication system. The first antenna 200 includes a metal branch 202, a first radiating element 204, a feed-in plate 206, and a signal feed-in element 208. The feed-in plate 206 has a feed-in part 207. The signal feed-in element 208 is electrically connected to the feed-in part 207 for transmitting radio signals to the first radiating element 204 via the feed-in plate 206. The first radiating element 204 is disposed near one side of the feed-in plate 206, and is electrically connected to the grounding unit 230. Radio signals are coupled between the first radiating element 204 and the feed-in plate 206. In other words, signals on the first radiating element 204 and the feed-in plate 206 are connected owing to the coupling effect so that the first radiating element 204 can transmit the wireless signals received from the feed-in plate 206.

The metal branch 202 is disposed near the other side of the feed-in plate 206 opposed to the first radiating element 204. A distance h2 between the metal branch 202 and the feed-in part 207 is substantially shorter than or equal to 5 mm. The feed-in plate 206 is also electrically connected to the grounding unit 230. The length of the first radiating element 204 and the length of the feed-in part 207 are substantially equal to a quarter-wavelength of an operational frequency; however, they do not have to be exactly the same. In the example shown in FIG. 2, the metal branch 202 is substantially parallel to the first radiating element 204. In other examples, the metal branch 202 does not have to be parallel to the first radiating element 204. The shortest distance between the metal branch 202 and the first radiating element 204 should be larger than a certain value. In a Bluetooth or Wi-Fi system, for example, the shortest distance between the metal branch 202 and the first radiating element 204 is substantially longer than or equal to 15 mm. In other systems having different operational frequencies, the shortest distance between the metal branch 202 and the first radiating element 204 may be varied. The metal branch 202 may guide reflected signals generated from the second antenna 210 and the third antenna 220 to the metal branch 202 so as to enhance isolations of the antennas 200, 210, and 220. Thus, antenna efficiency is improved.

The first antenna 200, the second antenna 210, and the third antenna 220 are disposed on the same substrate. The three antennas share the grounding unit 230 to connect to a system grounding unit of the wireless communication device 10. The radio signal processing unit 102 is disposed in the center of the antenna disposition area 250. The first antenna 200 is disposed on one side of the antenna disposition area 250. If drawing two virtual lines extended from the paths of the first radiating element 204 and the metal branch 202 (i.e. the virtual lines is substantially parallel to the direction D1), the first antenna 200 is located at one end of the virtual lines, while the second antenna 210 and the third antenna 220 are substantially located at the other ends of the two virtual lines. The second antenna 210 includes a second radiating element 212, a third radiating element 214, a shorting unit 216, and a signal feed-in element 218. The third antenna 220 includes a fourth radiating element 222, a fifth radiating element 224, a shorting unit 226, and a signal feed-in element 228. As shown in FIG. 2, the second antenna 210 and the third antenna 220 resemble a planar inverted-F antenna plus a shorting unit which connects the radiating element to a ground (i.e., the shorting unit 216, 226). The type of antenna being used for the second antenna 210 and the third antenna 220 does not limited to the planar inverted-F antenna type.

Other types of antennas (e.g., a monopole antenna with a parasitic element, a slot antenna, etc.) may be used as well.

Figure 3A:
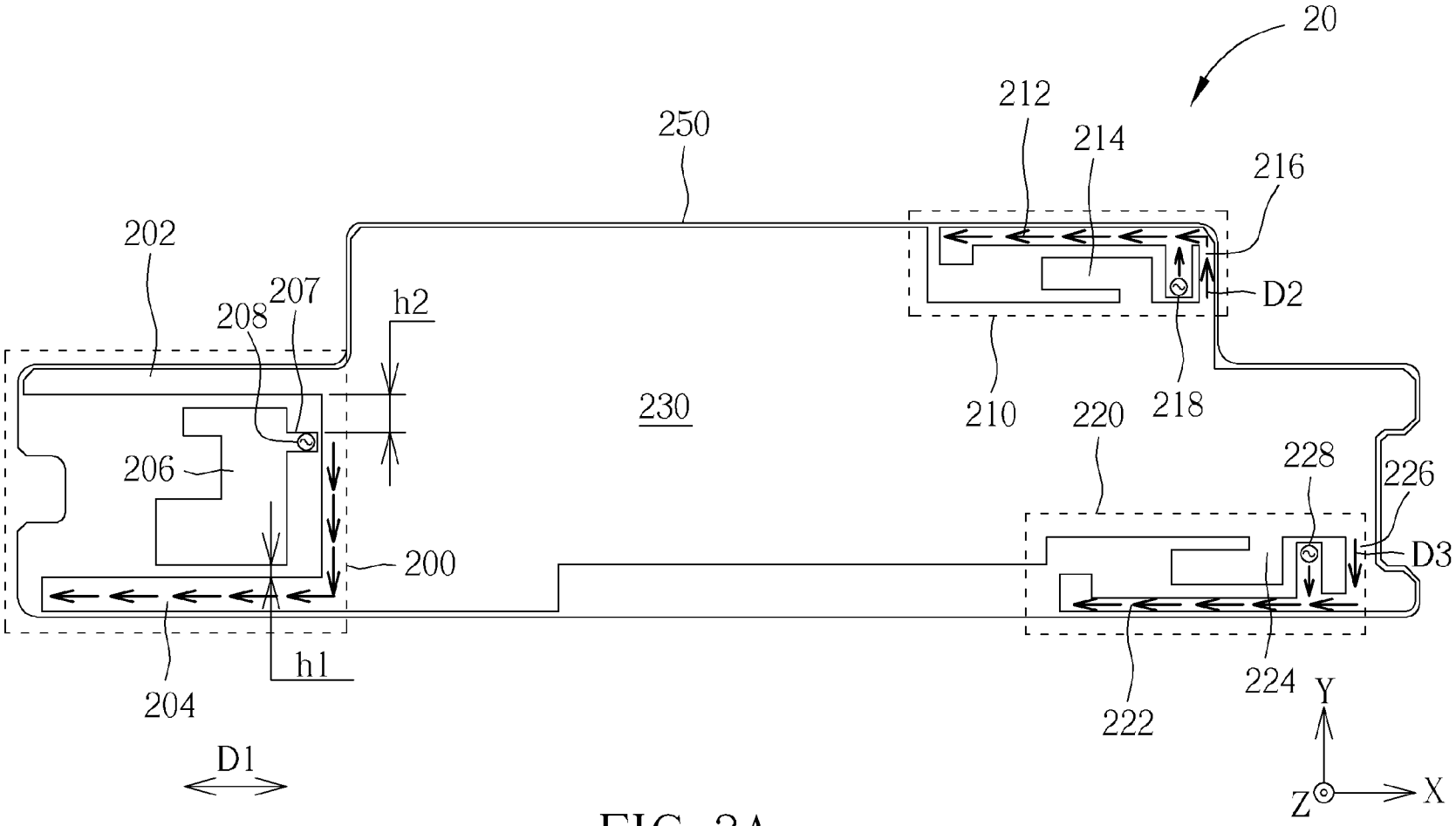
FIG. 3A shows a current distribution diagram of low-frequency signals for the radio-frequency device shown in FIG. 2.
Figure 3B:
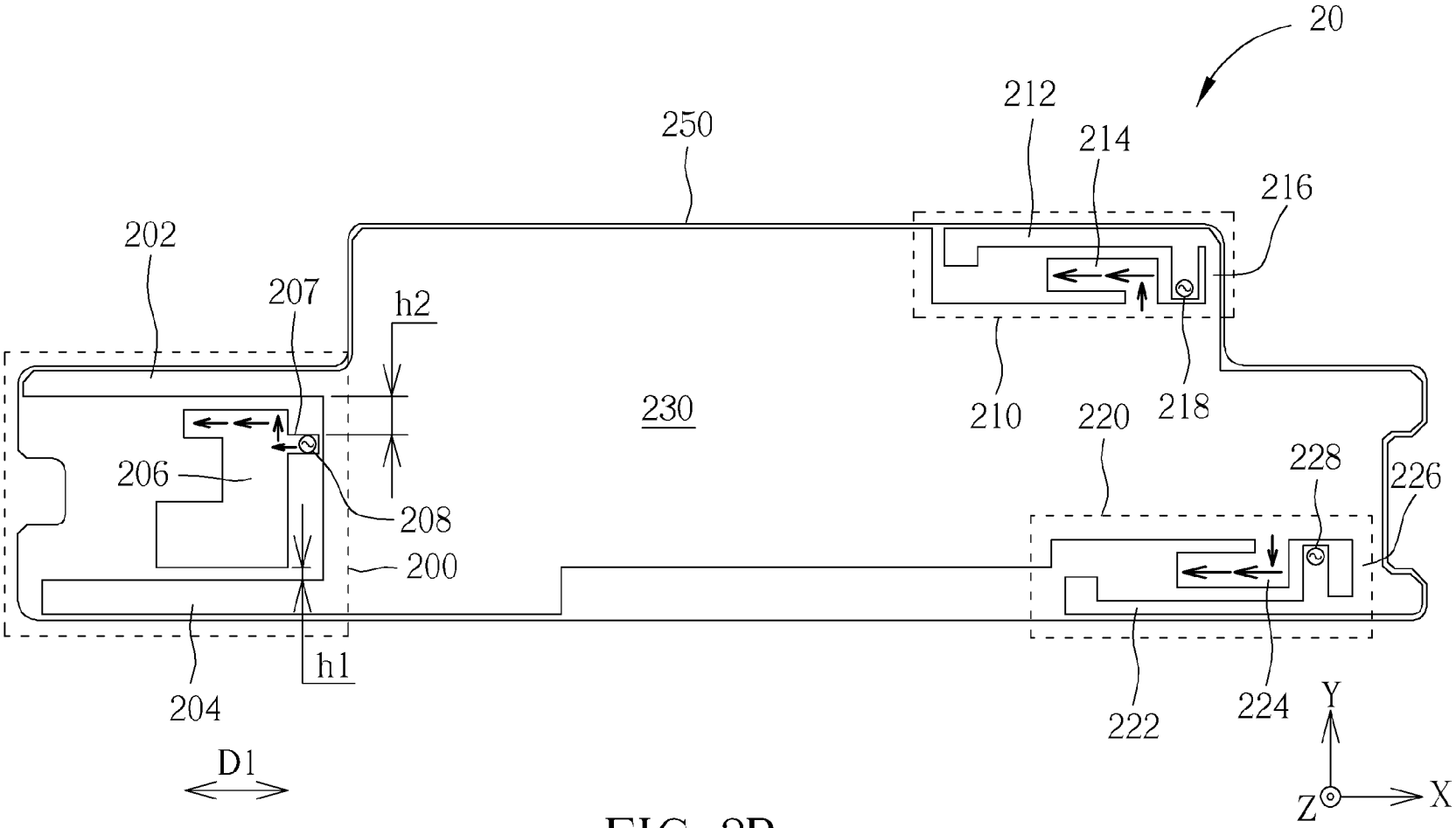
FIG. 3B shows a current distribution diagram of high-frequency signals for the radio-frequency device shown in FIG. 2.

The second radiating element 212 and the fourth radiating element 222 are used to excite lower frequency modes, while the third radiating element 214 and the fifth radiating element 224 are used to excite higher frequency modes. FIG. 3A and FIG. 3B illustrate the current distribution of the radio-frequency device 20 when all of the first antenna 200, the second antenna 210, and the third antenna 220 are transmitting or receiving signals at the same time. FIG. 3A shows the current distribution of low frequency signals, and FIG. 3B shows the current distribution of high frequency signals. Since the second antenna 210 and the third antenna 220 mirror each other, the currents induced by the radio signals on the second antenna 210 and the third antenna 220 in y-axis (e.g. the currents on the shorting unit 216 and the shorting unit 226) have opposite directions. Thus, good isolations between the second antenna 210 and the third antenna 220 may be achieved. In addition, the metal branch 202 may guide reflected signals generated from the second antenna 210 and the third antenna 220 to the metal branch 202 so that the reflected signals would not interfere with the operation of the first antenna 200. As such, isolations between the first antenna 200 and the antennas 210/220 may be enhanced. Moreover, the metal branch 202 may also guide most of the resonant current in the first antenna 200 to flow to the first radiating element 204, which therefore improves the efficiency of the first antenna 200.

Figure 4A:
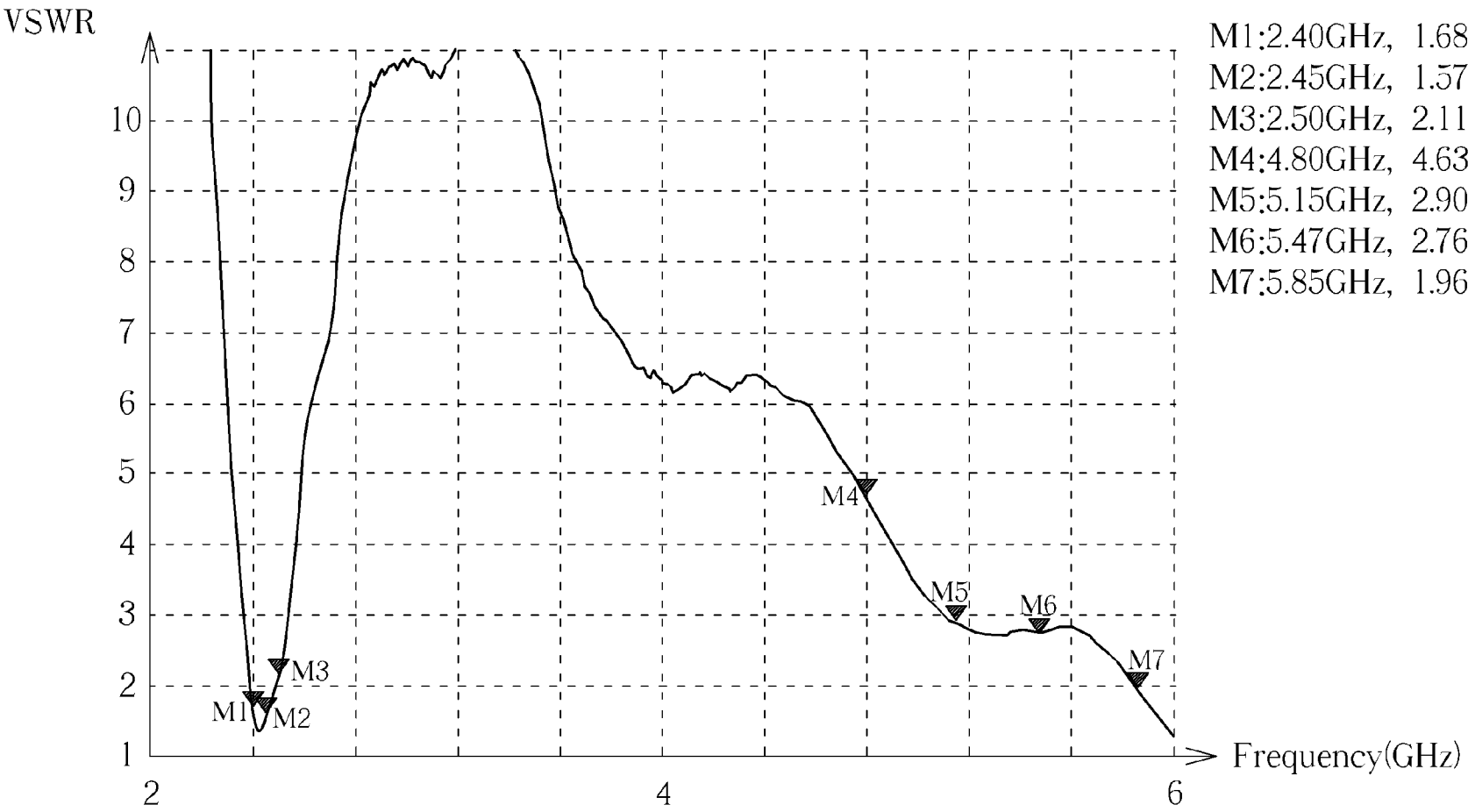
FIG. 4A to FIG. 4C are voltage-standing wave ratio (VSWR) diagrams of the radio-frequency device shown in FIG. 2.
Figure 4B:
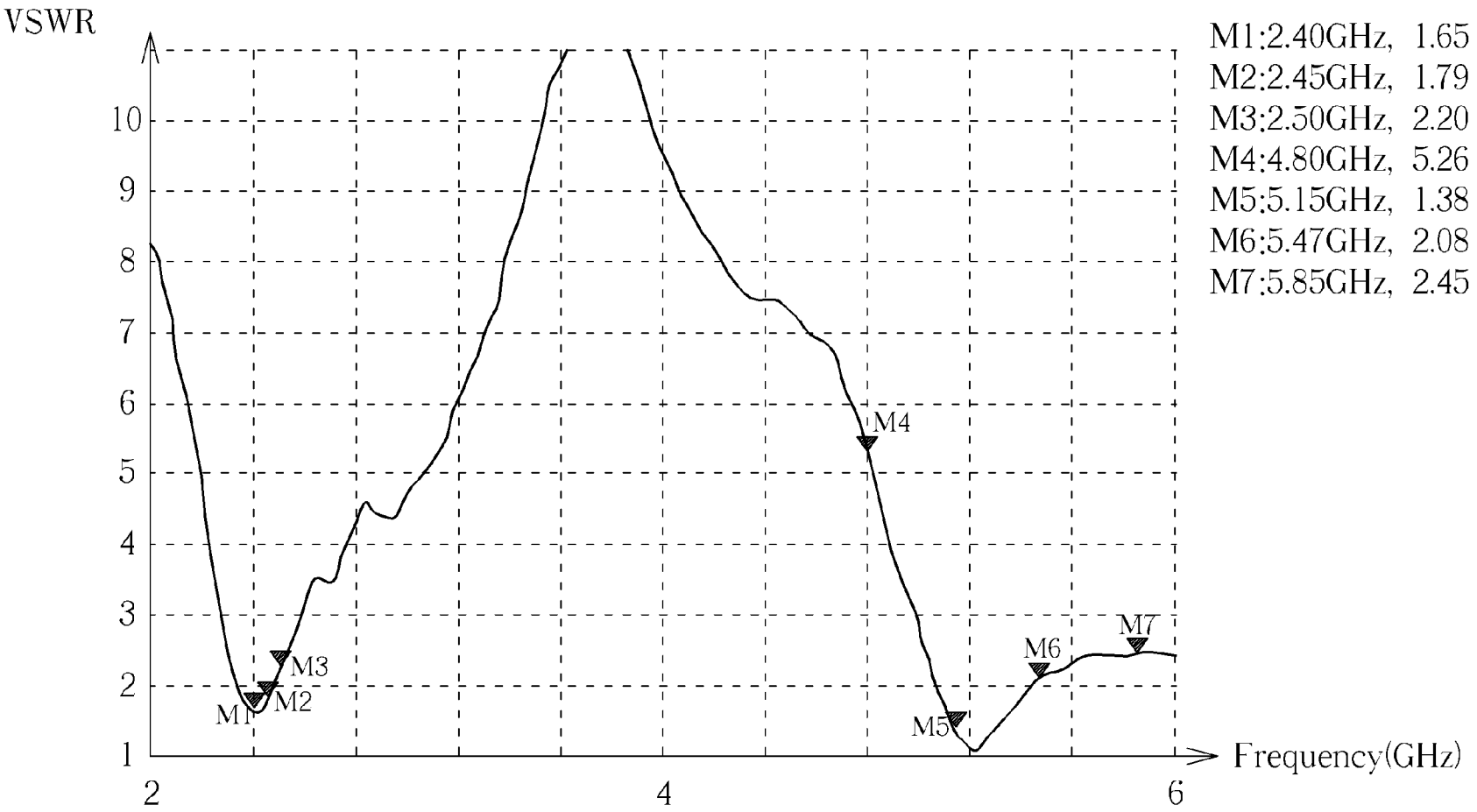
Figure 4C:
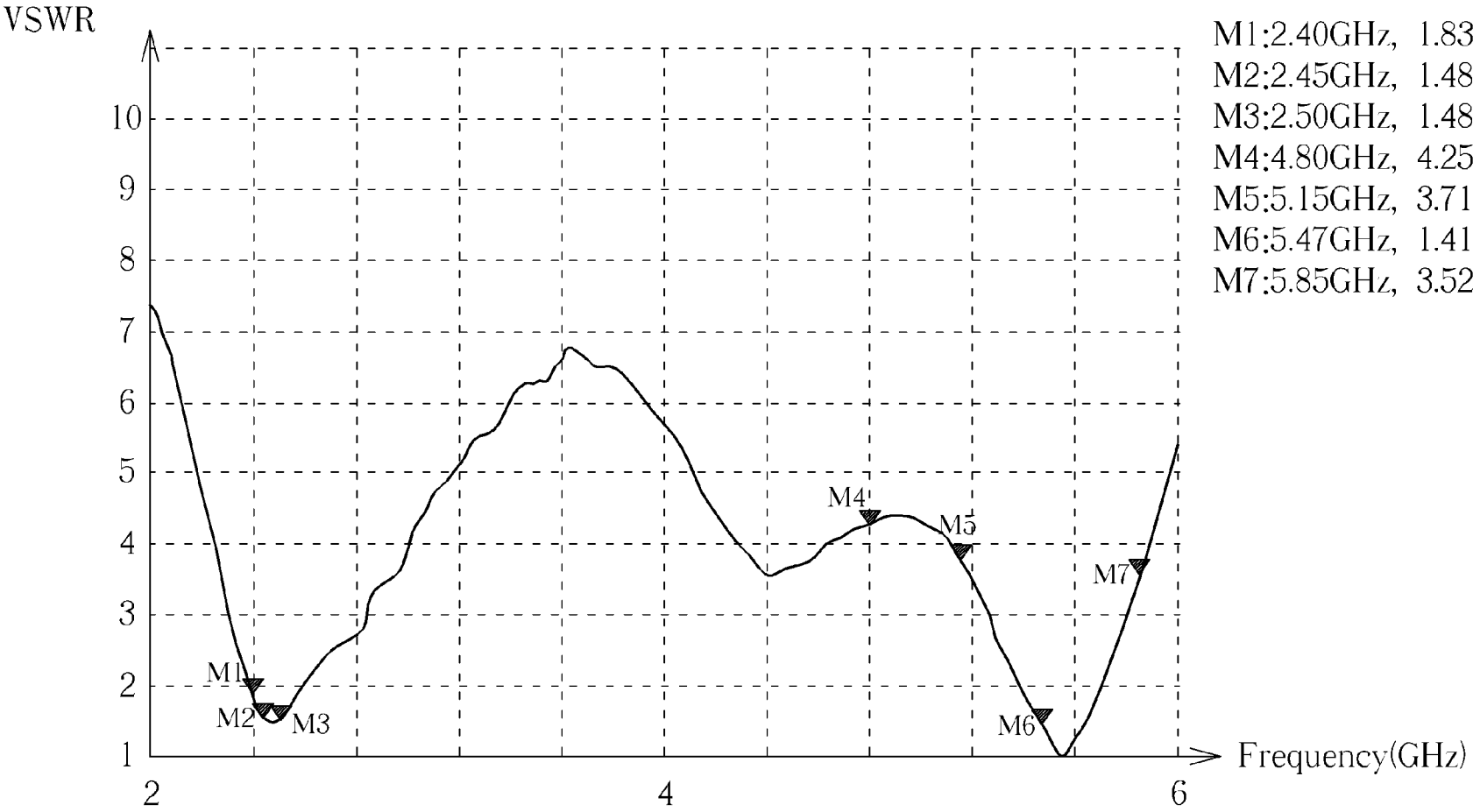
Figure 5A:
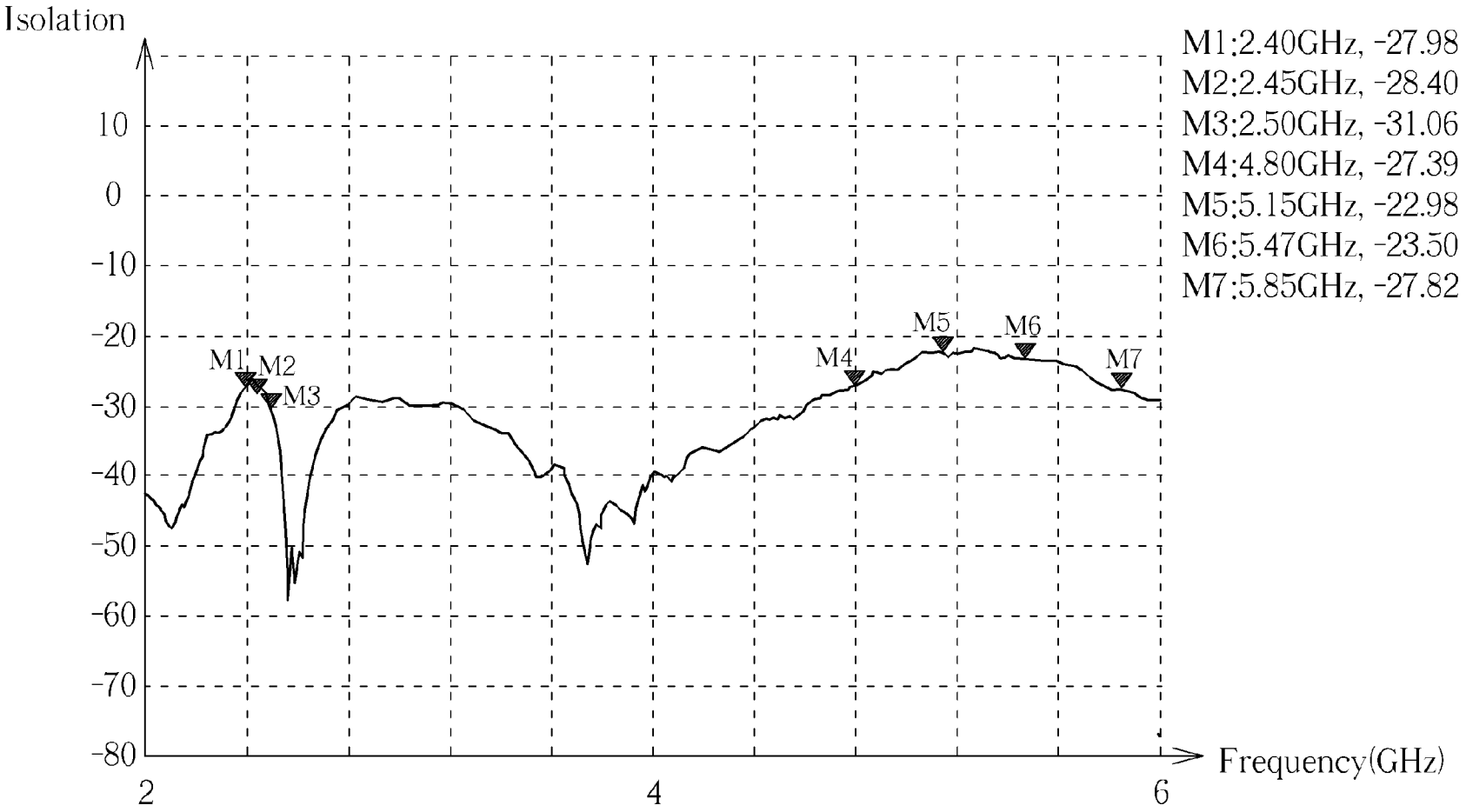
FIG. 5A and FIG. 5B are antenna isolation diagrams of the radio-frequency device shown in FIG. 2.
Figure 5B:
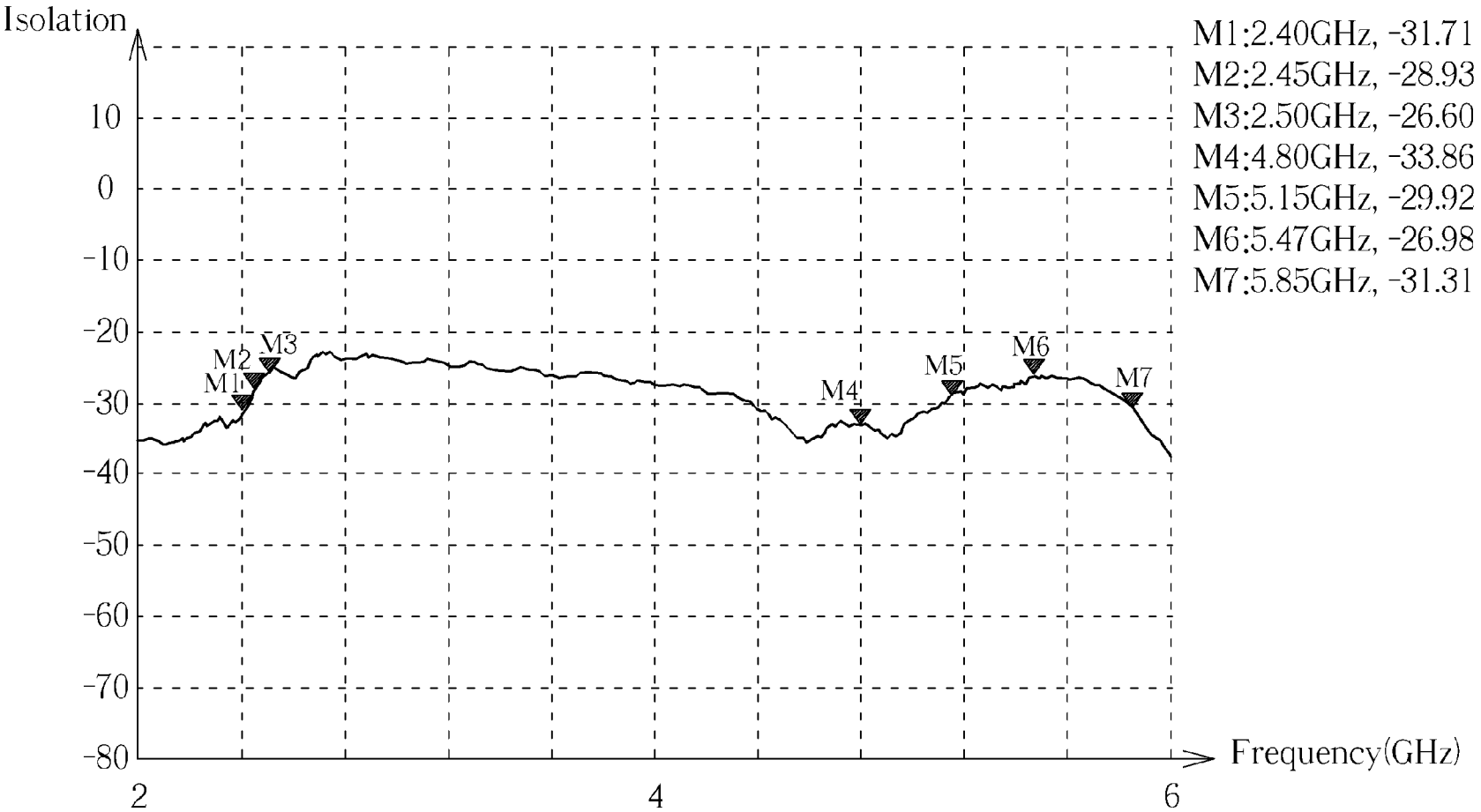

FIG. 4A, FIG. 4B, and FIG. 4C show voltage-standing wave ratio (VSWR) diagrams of the first antenna 200, the second antenna 210, and the third antenna 220, respectively. FIG. 5A shows the antenna isolation between the first antenna 200 and the second antenna 210, and FIG. 5B shows the antenna isolation between the first antenna 200 and the third antenna 220. These figures prove that all of the first antenna 200, the second antenna 210, and the third antenna 220 have broadband characteristics, and the isolations between each two antennas are approximately −25 dB or even better.

The embodiment of the present invention utilizes the metal branch 202 to guide the most of resonant current in the first antenna 200 to flow to the first radiating element 204 and guide the reflection current from the other antennas to flow to the metal branch 202. As such, the reflection current from the other antennas does not interfere with the resonant current on first radiating element 204, and thus the antennas may have preferable bandwidth, efficiency, and isolations. Those skilled in the art may make alterations and/or modifications according to the abovementioned embodiments. For instance, radio signals generated from the first antenna 200 are fed into the first radiating element 204 via the feed-in plate 206 by coupling, where the coupling gap h1 may be adjusted appropriately. The length, width, and shape of the coupling gap h1 may be altered to meet the performance requirement or accommodate the dimensions of antenna disposition area. The structure of the first antenna 200 may be modified such that the radio signals are fed into the first radiating element 204 by other feed-in method. In addition, the shape of the metal branch 202, the first radiating element 204, the feed-in plate 206, the second radiating element 212, the third radiating element 214, the fourth radiating element 222, or the fifth radiating element 224 may be stretched or changed along the x-, y-, or z-axis, and is not limited to that shown in FIG. 2. The shorting units 216 and 226 are used to connect the radiating elements 212 and 222 with the grounding unit 230 for adjusting the impedance matching. The shapes or forms of the shorting units 216 and 226 may be modified appropriately based on the entire antenna matching and bandwidth requirements. Moreover, the substrate on which the radio-frequency device 20 is set may be a printed circuit board (PCB) or other kind of substrate.

Figure 6:
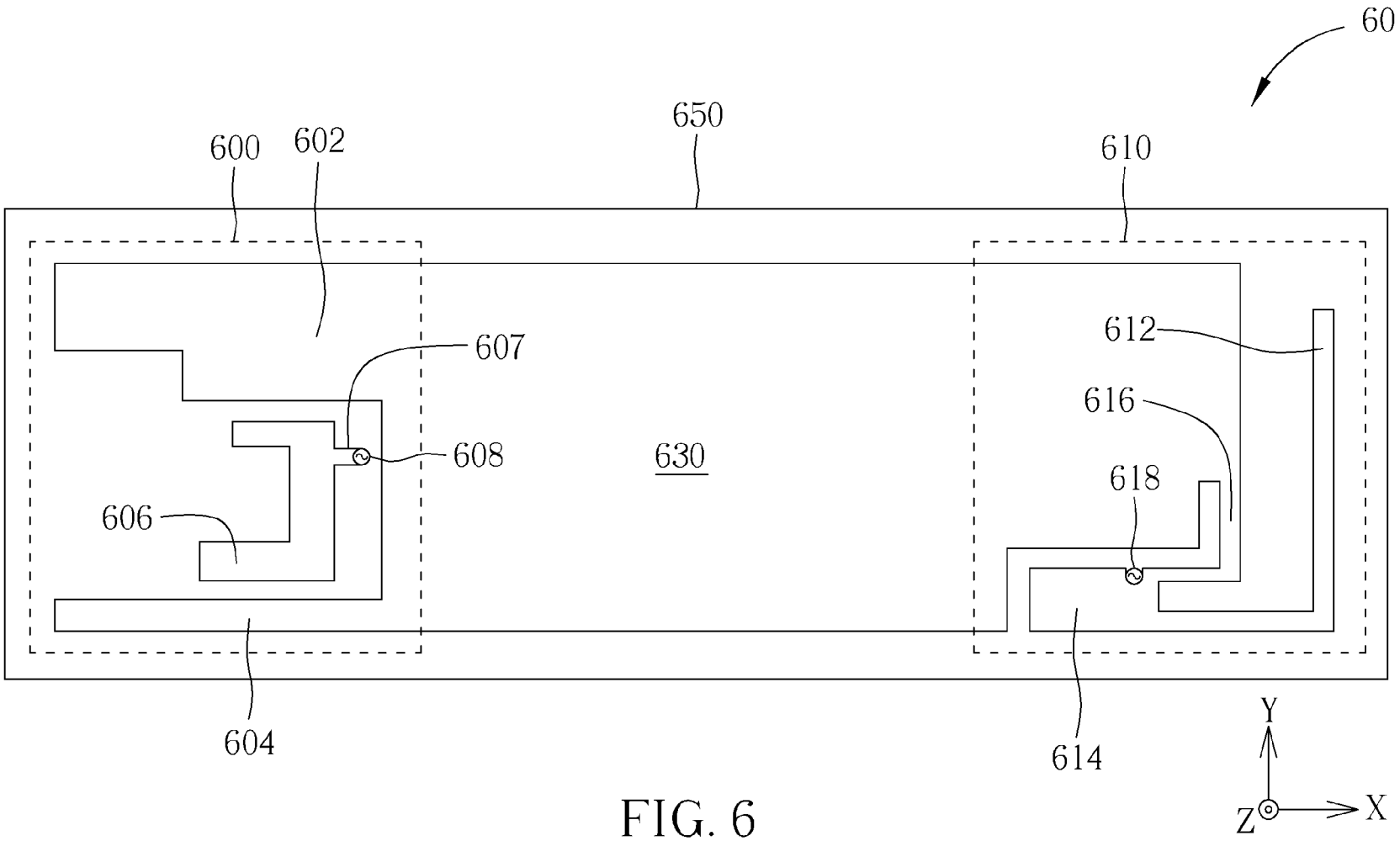
FIG. 6 is a schematic diagram of a radio-frequency device according to an embodiment of the present invention.
Figure 7A:
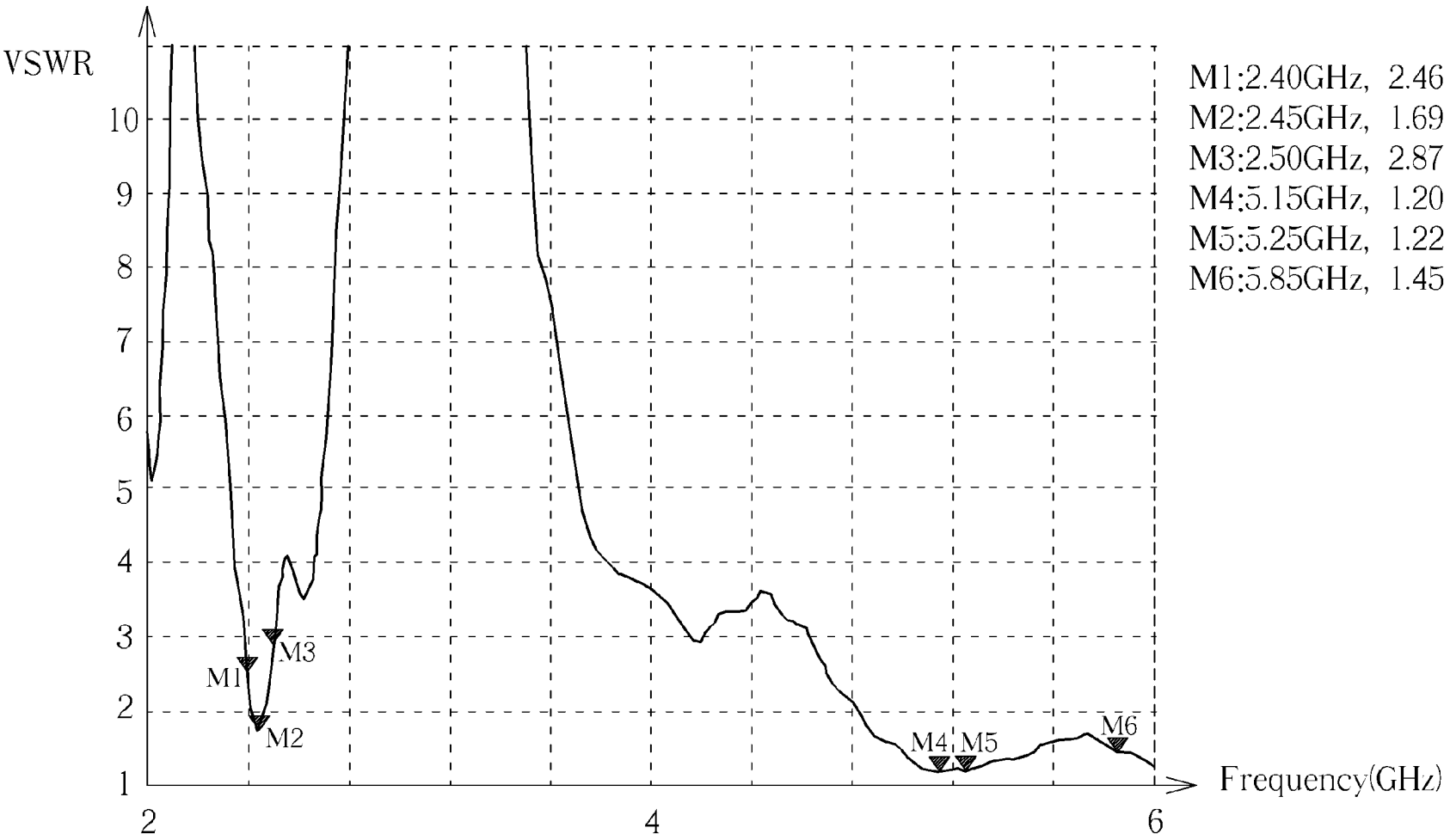
FIG. 7A and FIG. 7B are voltage-standing wave ratio (VSWR) diagrams of the radio-frequency device shown in FIG. 6.
Figure 7B:
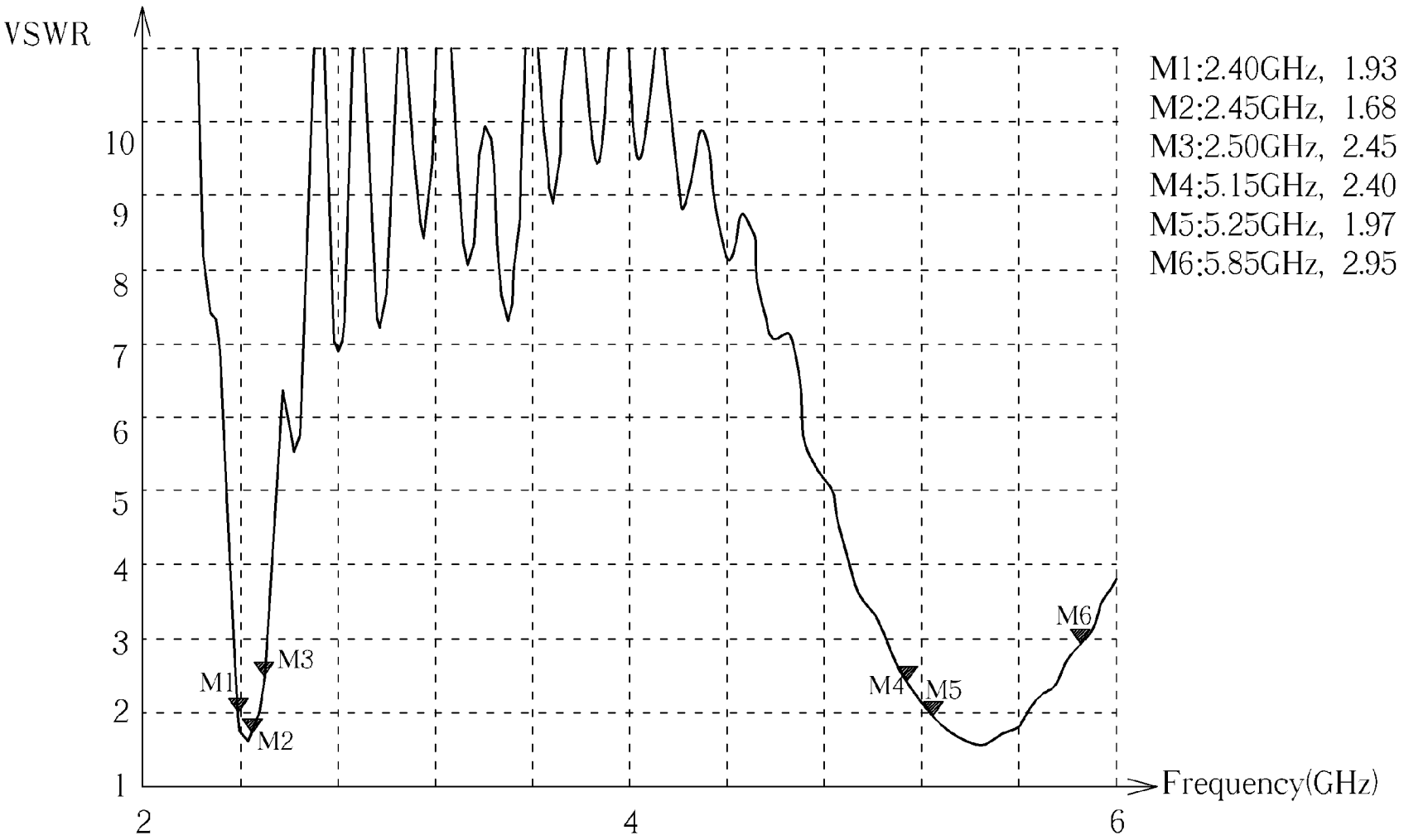
Figure 8:
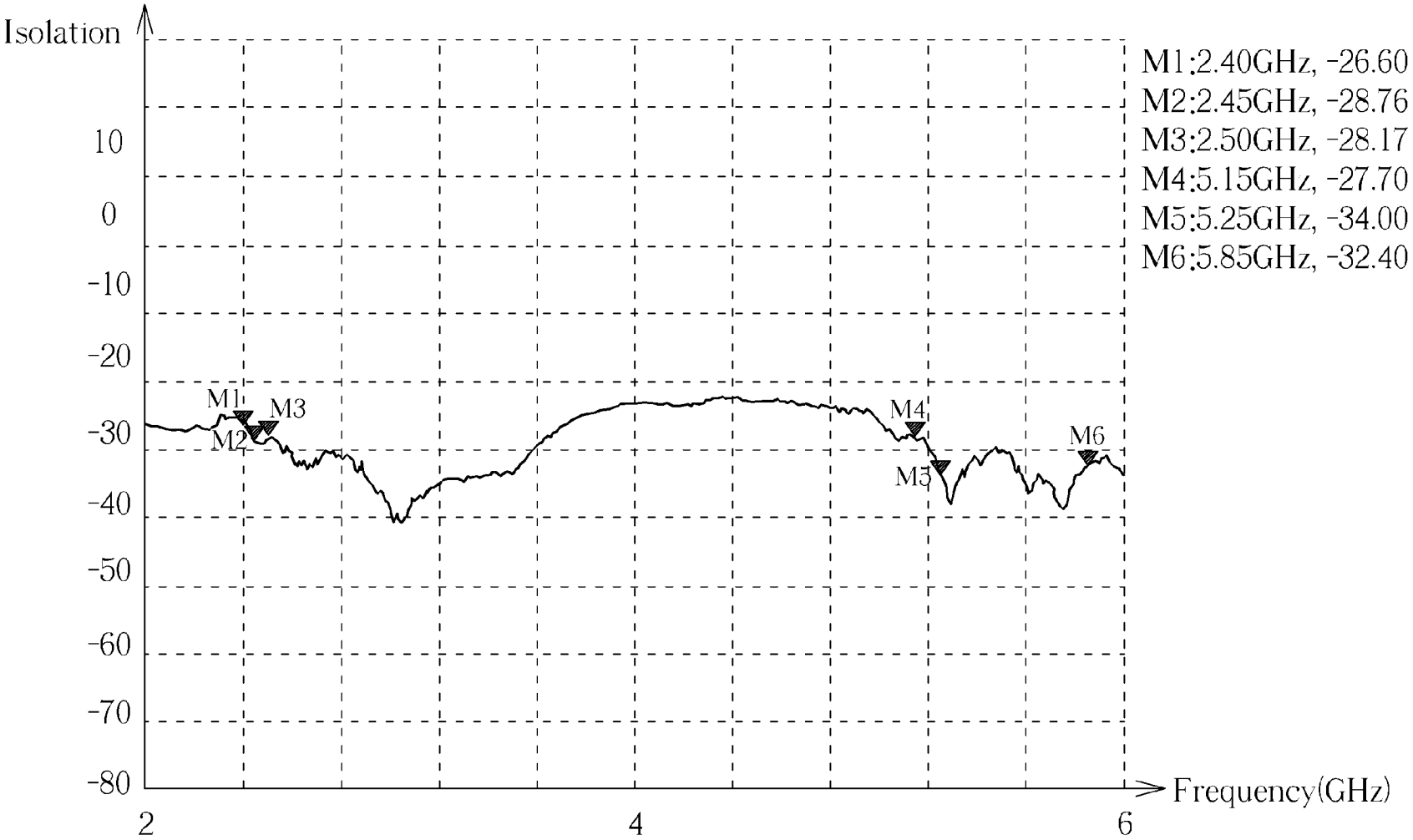
FIG. 8 is an antenna isolation diagram of the radio-frequency device shown in FIG. 6.

FIG. 6 is a schematic diagram of a radio-frequency device 60 according to another embodiment of the present invention. Different from the radio-frequency device 20, the radio-frequency device 60 is used for two-antenna application. In the antenna disposition area 650, only the first antenna 600 and the second antenna 610 are disposed. Noticeably, the shape and width of the metal branch 602 are different from those of the metal branch 200. Preferable antenna performance (good antenna isolations, efficiency, and broad bandwidth) is also achieved by the radio-frequency device 60 as long as the shortest distance between the metal branch 602 and the first radiating element 604 is longer than a specific value. In other words, the shape and width of the metal branch 602 may be modified appropriately without affecting the efficacy of the metal branch 602. The metal branch 602 can similarly guide most of the resonant current in the first antenna 600 to flow to the first radiating element 604 and guide the reflection current from the other antenna (i.e., the second antenna 610) to flow to the metal branch 602 without interfere with the current on the first radiating element 604, thereby improving the bandwidth, efficiency, and isolations. FIG. 7A is a VSWR diagram of the first antenna 600, FIG. 7B is a VSWR diagram of the second antenna 610, and FIG. 8 is an antenna isolation diagram of the first antenna 600 and the second antenna 610. As shown in FIG. 7A to FIG. 8, the first antenna 600 and the second antenna 610 have preferable bandwidth, and the isolation between the two antennas is better than −25 dB in the operational frequency bands.

The first radiating element 604 of the first antenna 600 is used to excite lower frequency resonant modes. In some applications, the feed-in plate 606 may be used as a high frequency radiating element to excite higher frequency resonant modes. In the second antenna 610, the shorting unit 616 connects the second radiating element 612 and a third radiating element 614 with the grounding unit 630 for adjusting the impedance matching. The shorting unit 616 is not constrained to any forms or shapes; it may be appropriately modified to optimize for the matching and bandwidth of the second antenna 610. In addition, all related alterations and modifications regarding the radio-frequency device 20 mentioned above may be similarly applied to the radio-frequency device 60.

Furthermore, the antenna radiation frequency, bandwidth and efficiency are closely correlated with the antenna shape and the materials used in the antenna. Therefore, designers may appropriately modify, for example, the dimensions, width, and spacing of the elements/units/components in the antennas 200, 210, 220, 600, and 610 to comply with requirements of the wireless communication systems. Any alterations and modifications such as varying the material, manufacturing methods, shape, and position of the components should be within the scope of the present invention.

To sum up, the present invention includes the metal branch to guide the resonant current of one antenna and the reflection current of other antennas to avoid interference between multiple sets of antennas. In this way, isolations between each two of the antennas are enhanced. Thus, multiple sets of antennas may be disposed within a limited area while all antennas may transmit radio signals simultaneously with good efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A radio-frequency device for a wireless communication device, comprising:
an antenna disposition area;
a grounding unit, for providing ground;
a first antenna, disposed in the antenna disposition area for transmitting or receiving a first radio signal, the first antenna comprising:
a feed-in plate, having a feed-in part;
a first radiating element, coupled to the feed-in plate and electrically connected to the grounding unit for emitting the first radio signal;
a first signal feed-in element, electrically connected to the feed-in part for transmitting the first radio signal to the first radiating element via the feed-in plate such that the first radio signal is emitted via the first radiating element; and
a metal branch, having two ends, wherein one of the ends is electrically connected to the grounding unit, and the other end is a free end; and
a second antenna, disposed in the antenna disposition area for transmitting or receiving a second radio signal;
wherein the grounding unit between the first antenna and the second antenna is shared by the first antenna and the second antenna, the feed-in plate is disposed in-between the metal branch and the first radiating element, and the metal branch is used for guiding a reflected signal generated from the second antenna to the metal branch so as to enhance isolations of the first antenna and the second antenna.

2. The radio-frequency device of claim 1, wherein the first radio signal is fed into the first radiating element via the feed-in plate by coupling.

3. The radio-frequency device of claim 1, wherein the second antenna comprises:
a second radiating element;
a third radiating element, electrically connected to the grounding unit;
a second signal feed-in element, electrically connected to the second radiating element for transmitting the second radio signal to the second radiating element such that the second radio signal is emitted via the second radiating element; and
a first shorting unit, electrically connected between the second radiating element and the grounding unit.

4. The radio-frequency device of claim 1, wherein the radio-frequency device further comprises a third antenna, disposed in the antenna disposition area for transmitting or receiving a third radio signal, the third antenna comprising:
a fourth radiating element;
a fifth radiating element, electrically connected to the grounding unit;
a third signal feed-in element, electrically connected to the fourth radiating element for transmitting the third radio signal to the fourth radiating element such that the third radio signal is emitted via the fourth radiating element; and
a second shorting unit, electrically connected between the fourth radiating element and the grounding unit.

5. The radio-frequency device of claim 4, wherein a direction of the induced current of the second radio signal on the first shorting unit is opposite to a direction of the induced current of the third radio signal on the second shorting unit.

6. The radio-frequency device of claim 1, wherein a radio signal processing unit of the wireless communication device is disposed between the first antenna and the second antenna in the antenna disposition area.

7. The radio-frequency device of claim 1, wherein the metal branch is substantially parallel to the first radiating element.

8. The radio-frequency device of claim 1, wherein a distance between the metal branch and the feed-in part is substantially shorter than or equal to 5 mm.

9. The radio-frequency device of claim 1, wherein the shortest distance between the metal branch and the first radiating element is substantially longer than or equal to 15 mm.

10. A wireless communication system, comprising:
a system grounding unit, for providing ground;
a radio signal processing unit, for processing a plurality of radio signals; and
a radio-frequency device, comprising:
an antenna disposition area, wherein the radio signal processing unit is disposed in the antenna disposition area;
a grounding unit, electrically connected to the system grounding unit;
a first antenna, disposed in the antenna disposition area for transmitting or receiving a first radio signal of the plurality of radio signals, the first antenna comprising:
a feed-in plate, having a feed-in part;
a first radiating element, coupled to the feed-in plate and electrically connected to the grounding unit for emitting the first radio signal;
a first signal feed-in element, electrically connected to the feed-in part for transmitting the first radio signal to the first radiating element via the feed-in plate such that the first radio signal is emitted via the first radiating element; and
a metal branch, having two ends, wherein one of the ends is electrically connected to the grounding unit, and the other end is a free end; and
a second antenna, disposed in the antenna disposition area for transmitting or receiving a second radio signal of the plurality of radio signals;
wherein the grounding unit between the first antenna and the second antenna is shared by the first antenna and the second antenna, the feed-in plate is disposed in-between the metal branch and the first radiating element, and the metal branch is used for guiding a reflected signal generated from the second antenna to the metal branch so as to enhance isolations of the first antenna and the second antenna.

11. The wireless communication device of claim 10, wherein the first radio signal is fed into the first radiating element via the feed-in plate by coupling.

12. The wireless communication device of claim 10, wherein the second antenna comprises:
a second radiating element;
a third radiating element, electrically connected to the grounding unit;
a second signal feed-in element, electrically connected to the second radiating element for transmitting the second radio signal to the second radiating element such that the second radio signal is emitted via the second radiating element; and
a first shorting unit, electrically connected between the second radiating element and the grounding unit.

13. The wireless communication device of claim 10, wherein the radio-frequency device further comprises a third antenna, disposed in the antenna disposition area for transmitting or receiving a third radio signal of the plurality of radio signals, the third antenna comprising:

a fourth radiating element;

a fifth radiating element, electrically connected to the grounding unit;

a third signal feed-in element, electrically connected to the fourth radiating element for transmitting the third radio signal to the fourth radiating element such that the third radio signal is emitted via the fourth radiating element; and a second shorting unit, electrically connected between the fourth radiating element and the grounding unit.

14. The wireless communication device of claim 13, wherein a direction of the induced current of the second radio signal on the first shorting unit is opposite to a direction of the induced current of the third radio signal on the second shorting unit.

15. The wireless communication device of claim 10, wherein the radio signal processing unit is disposed between the first antenna and the second antenna in the antenna disposition area.

16. The wireless communication device of claim 10, wherein the metal branch is substantially parallel to the first radiating element.

17. The wireless communication device of claim 10, wherein a distance between the metal branch and the feed-in part is substantially shorter than or equal to 5 mm.

18. The wireless communication device of claim 10, wherein the shortest distance between the metal branch and the first radiating element is substantially longer than or equal to 15 mm.

* * * * *